US007708167B2

(12) United States Patent
Krengel et al.

(10) Patent No.: US 7,708,167 B2
(45) Date of Patent: May 4, 2010

(54) DISPENSING APPARATUS

(75) Inventors: Kenneth W. Krengel, Chicago, IL (US); Joseph T. Hudson, Chicago, IL (US); Paul D Hatch, Chicago, IL (US); Toshihiro Fujimura, Chicago, IL (US)

(73) Assignee: The Design Society, Inc., Chicago, IL (US)

( * ) Notice: Subject to any disclaimer, the term of this patent is extended or adjusted under 35 U.S.C. 154(b) by 1052 days.

(21) Appl. No.: 10/571,446

(22) PCT Filed: Sep. 16, 2004

(86) PCT No.: PCT/US2004/031035

§ 371 (c)(1),
(2), (4) Date: Mar. 13, 2006

(87) PCT Pub. No.: WO2005/027702

PCT Pub. Date: Mar. 31, 2005

(65) Prior Publication Data

US 2007/0023455 A1 Feb. 1, 2007

(51) Int. Cl.
*B67D 1/07* (2006.01)
*B67D 7/56* (2010.01)
*B65D 69/00* (2006.01)

(52) U.S. Cl. ..... 222/192; 222/156; 222/325; 222/383.1; 206/226; 239/289

(58) Field of Classification Search ..... 222/192, 222/156, 324, 383.1; 206/226; 239/289
See application file for complete search history.

(56) References Cited

U.S. PATENT DOCUMENTS

| | | | |
|---|---|---|---|
| 1,582,645 | A | 4/1926 | Findley |
| 4,436,224 | A | 3/1984 | McInerny |
| 5,819,989 | A | 10/1998 | Saraceni |
| 6,138,874 | A | 10/2000 | Audrey |
| 6,431,405 | B2 | 8/2002 | Irwin |
| 6,644,563 | B2 | 11/2003 | Presson |
| 6,698,626 | B2 | 3/2004 | McKay |

FOREIGN PATENT DOCUMENTS

WO WO 2005/027702 A2 3/2005

OTHER PUBLICATIONS

International Search Report and Written Opinion of the International Searching Authority with regard to International Application No. PCT/US04/31035.

*Primary Examiner*—Kevin P Shaver
*Assistant Examiner*—Melvin A Cartagena
(74) *Attorney, Agent, or Firm*—Neal Gerber & Eisenberg LLP

(57) ABSTRACT

A dispensing apparatus is disclosed. The dispensing apparatus comprises a liquid dispenser and a towel dispenser. The liquid dispenser further comprises a container member and an expelling member. The towel dispenser is disposed adjacent to and in contact with a portion of the container member of the liquid dispenser. Liquid is dispensed, through the expelling member of the liquid dispenser, in a substantially downward direction.

7 Claims, 4 Drawing Sheets

DISPENSING APPARATUS

CROSS-REFERENCE

This application is the National Stage of International Application No. PCT/US2004/031035 filed on Sep. 16, 2004; which claims priority of U.S. Provisional Patent Application Ser. No. 60/503,446 filed on Sep. 16, 2003. These prior applications are incorporated herein in their entirety by reference.

FIELD OF THE INVENTION

The Present Invention relates to a dispensing apparatus and, more particularly, to an apparatus for dispensing a liquid for cleaning, dispensing and collecting towels which may be used in conjunction with the liquid.

BACKGROUND OF THE INVENTION

In sports or other activities, there are many situations in which it is necessary, but impractical, to maintain clean hands. For instance, when playing a round of golf, it is fairly common for players to get mud, food or other liquids on their hands. However, access to bathroom facilities is typically inconvenient or impossible. Similarly, the same issues can arise when participating in other outdoor activities, such as fishing, playing tennis, camping, hunting or other similar activities, which require a person to be away from bathroom facilities for an extended period of time.

Currently, portable devices do exist which assist in the maintenance of hygiene in environments where such facilities are not readily available. For example, U.S. Pat. No. 5,819,989, issued to Saraceni on 13 Oct. 1998, discloses a combination dispenser comprising both a cleaning solution and a towel dispenser. See, Saraceni, Abstract. Generally, the Saraceni reference provides a portable means by which a person can use a cleaning solution, complete with a means for wiping up any excess.

However, the Saraceni reference does not disclose a means for which the used paper towels can be disposed of properly. Further, it does not protect the towels from outside factors, such as rain and snow. Finally, the dispenser in the Saraceni reference does not provide for the downward expelling of the cleaning solution—an aspect that is impractical when considering the potential use of hygiene, as well as preventing wasteful use of the cleaning solution.

Therefore, the need exists for an apparatus that allows one to maintain proper hygiene that overcomes the disadvantages stated above.

SUMMARY OF THE INVENTION

In accordance with the objects of the Present Invention, dispensing apparatus is disclosed. The dispensing apparatus comprises a liquid dispenser and a towel dispenser. The liquid dispenser further comprises a container member and an expelling member. The towel dispenser is disposed adjacent to and in contact with a portion of the container member of the liquid dispenser. Liquid is dispensed, through the expelling member of the liquid dispenser, in a substantially downward direction.

A better understanding of the objects, advantages, features, properties and relationships of the Present Invention will be obtained from the following detailed description and accompanying drawings which set forth illustrative embodiments that are indicative of the various ways in which the principles of the Present Invention may be employed.

BRIEF DESCRIPTION OF THE DRAWINGS

For a better understanding of the Present Invention, reference may be had to preferred embodiments shown in the following drawings, in which.

DETAILED DESCRIPTION OF THE PRESENTLY-PREFERRED EMBODIMENTS

Figure 1:
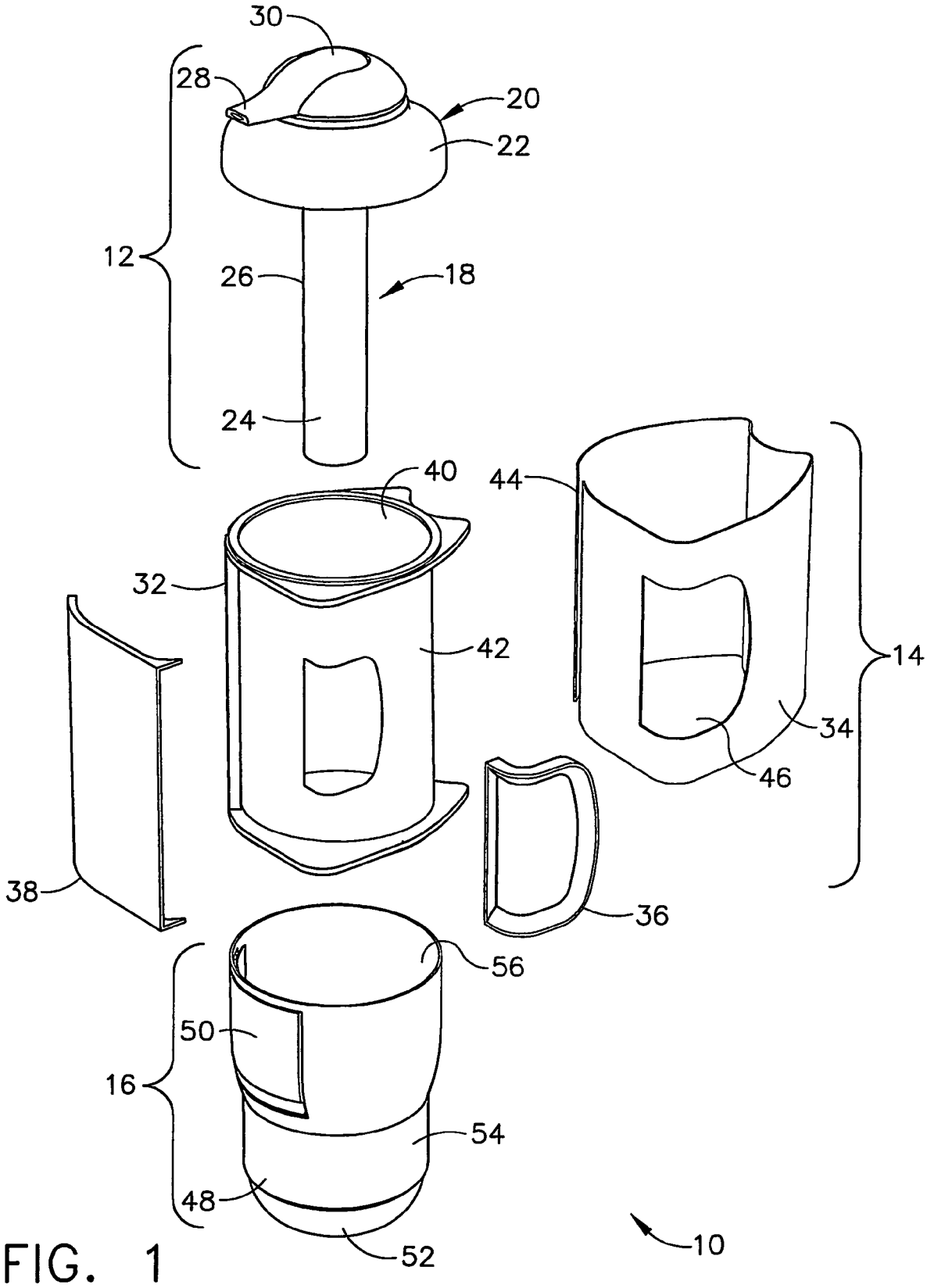
FIG. 1 illustrates an exploded perspective view of a dispensing apparatus, made in accordance with the Present Invention.

The Present Invention provides a combination dispensing apparatus comprised of a liquid dispenser, a towel dispenser and a refuse receiver, where the dispensing apparatus may be positioned in situations in which running water (or any similar method of cleaning) is inconvenient, impractical or non-existent. For example, it is contemplated that the Present Invention may be attached to a golf cart or similar apparatus, thereby allowing golfers or others to clean their faces, hands or clubs during a round of golf. However, it should also be appreciated by those with skill in the art that the Present Invention may be used in connection with other sporting applications such as boating, tennis, etc. It is also contemplated that the Present Invention may be utilized in outhouses or other locations where hygiene is necessary and/or important, but where standard means for achieving such hygiene are inadequate. Thus, it should be realized that, although the description of the Present Invention may describe it in a specific context, i.e., in connection with golf carts, such a description is only exemplary in nature and should not be construed as limiting the application of the Present Invention in any manner.

For purposes of the description herein, the use of the term "liquid" shall generally mean any substance that flows readily and is difficult to compress. More specifically, "liquid" shall mean any substance commonly known as a liquid, any substance that is liquid-like (i.e., gel, solution, solvent or solute) in nature or any reasonably flowable powder. For purposes of the description herein, "liquid" shall include any substance commonly used for cleaning and/or possessing cleaning or cleansing properties. Non-exhaustive examples of liquids, for purposes of the description herein, include cleaning solutions, cleansing liquids, soap, water, etc.

Additionally, the use of the term "towel," for purposes of the description herein, shall generally mean any piece of absorbent cloth or paper used for wiping and drying. More specifically, "towel" shall mean any device comprised primarily of cloth, a cloth-type substance, paper or other absorbent material, which is primarily, though not exclusively, used for cleaning, wiping and/or drying. Further, the term "towel" necessarily includes those towels that are pre-moistened, aromatic, soap-injected, etc. Non-exhaustive examples of towels, for purposes of the description herein, include paper towels, tissue papers, cloth towels, chamois, etc.

When describing the details of the Present Invention, references will be made to the Figures, in which like numerals will denote the same (or similar) elements. Referring to the Figures, dispensing apparatus 10 is illustrated as generally comprising liquid dispenser 12, towel dispenser 14 and refuse collector 16. It should be understood, however, that each of the liquid dispenser 12, towel dispenser 14 and refuse collector 16 have separate and distinct functions, and that one or more of these elements may be removed and/or rearranged with respect to the other elements. Therefore, for example, the dispensing apparatus may be designed to consist of a liquid dispenser 12 and towel dispenser 14 only.

As most accurately shown in FIG. 1, for expelling liquid, liquid dispenser 12 includes container member 18 and expelling member 20. Container member 18 is further comprised of top portion 22, bottom portion 24 and middle portion 26. Preferably, container member 18 may be made of any sturdy, lightweight, non-porous, non-corrosive material capable of holding various types of liquids, as defined above. In this regard, container member 18 may be a single molded plastic piece or multiple independent pieces that are joined by snap fitting, adhesives, screws, nuts, bolts or other materials known in the art, provided that the container member 18 is watertight.

Figure 2:
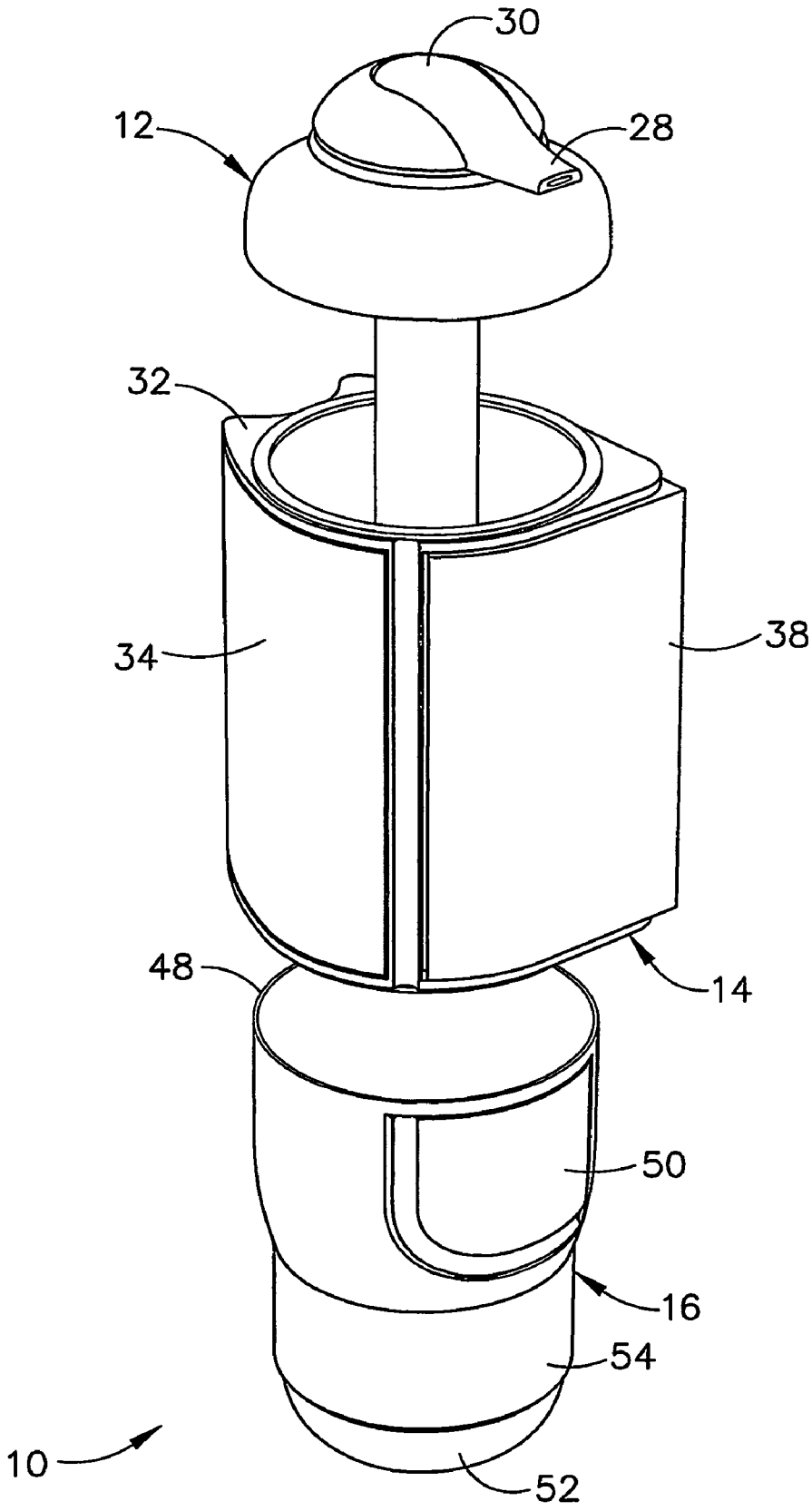
FIG. 2 illustrates a partially-exploded perspective view of the dispensing apparatus of FIG. 1.
Figure 3B:
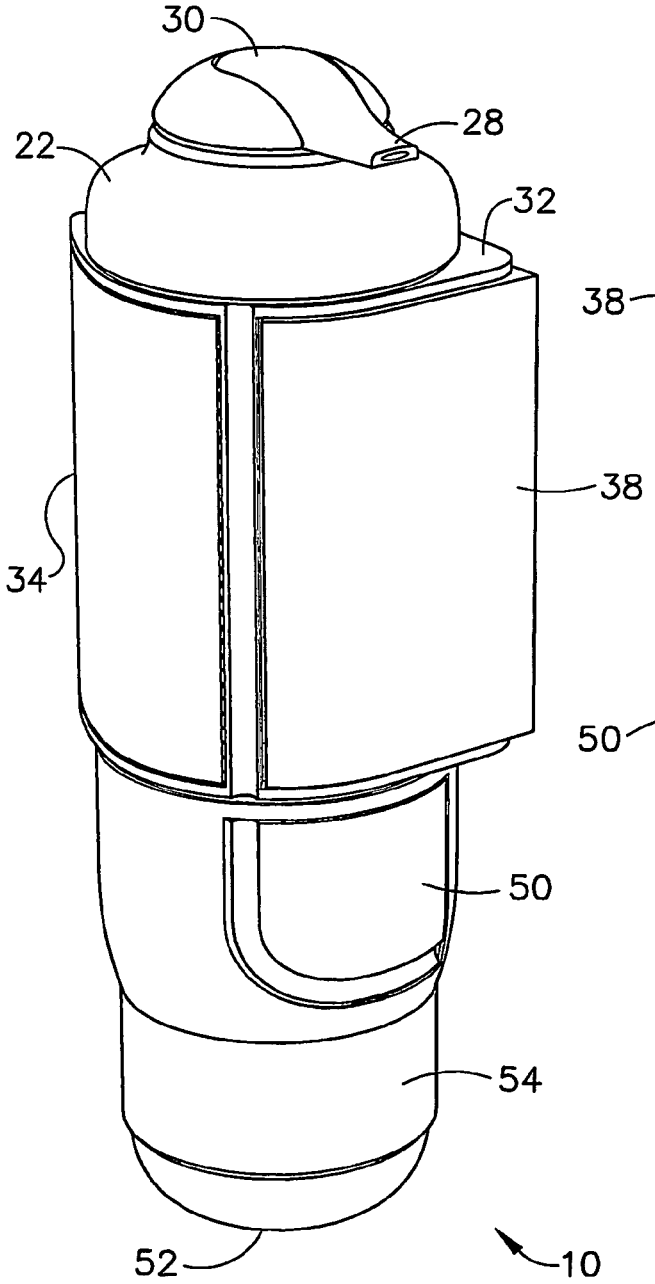
FIGS. 3A-3B illustrate two front perspective views of the dispensing apparatus of FIG. 1.
Figure 3A:
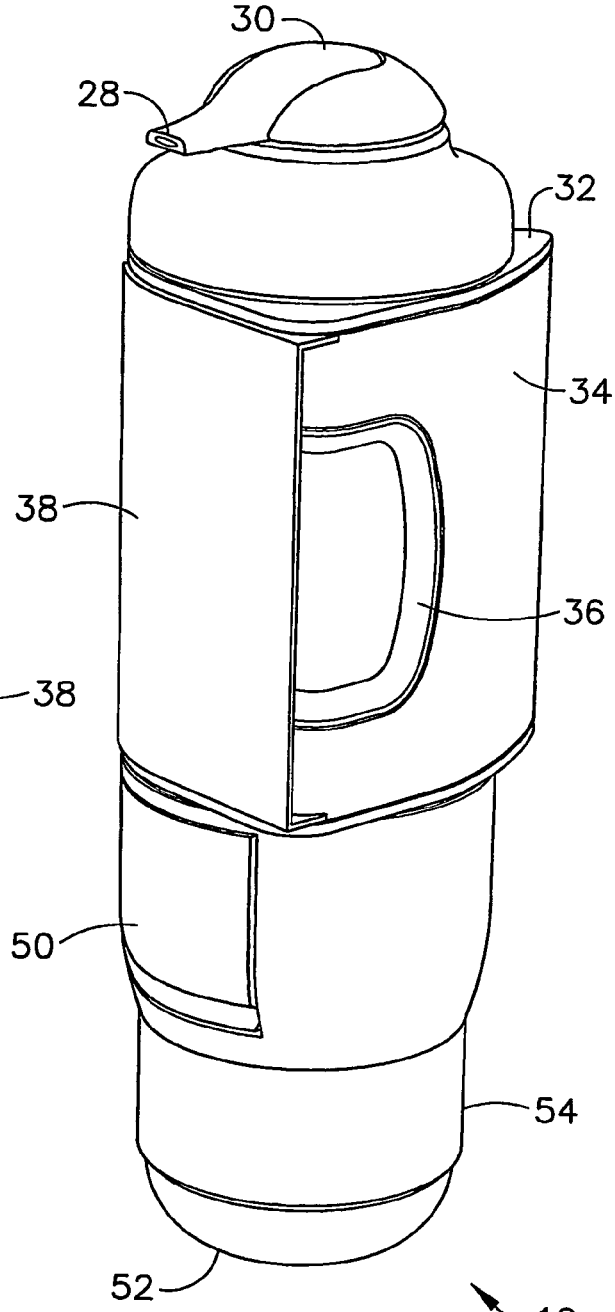

Container member 18, as a whole, preferably possesses an overall width. Moreover, each portion within container member 18 (i.e., top portion 22, bottom portion 24 and middle portion 26) have an individual width. These individual widths may or may not be equal to the overall width of container member 18 or each other, depending on the uniformity and shape of container member 18. For instance, container member 18 may represent a uniform tube; in such a case, the overall width of container member 18 would be equal to the overall individual widths of top portion 18, bottom portion 24 and middle portion 26. However, as is illustrated in FIGS. 1 and 2, container member 18 is not a uniform shape. That is, the individual width of top portion 22 is different from not only the individual widths of bottom portion 24 and middle portion 26, but also of the overall width of container member 18.

As illustrated in the Figures, container member 18 is tubular in nature, although it is contemplated that container member 18 may be formed of any particular shape such that the tenets and teachings of the Present Invention are maintained. Moreover, although not shown, top portion 22, bottom portion 24 and middle portion 26 collectively define a containment cavity. The containment cavity receives and stores the liquid until it is necessary to dispense the liquid from liquid dispenser 12.

Further, although not illustrated by the Figures, top portion 22 of container member 18 may possess an aperture (not shown). It is through the aperture that a liquid may be placed inside containment cavity for storage, and also through the aperture that the liquid may be expelled from the containment cavity by liquid dispenser 12. In addition, an aperture may alternatively or concurrently be located on bottom portion 24 of container member 18, or in any other location that would allow for ease of access to the aperture.

To expel liquid from the containment cavity, expelling member 20 is preferably removably attached to top portion 22 of container member 18 of liquid dispenser 12. Expelling member 20 preferably comprises a means by which the liquid contained within containment cavity is expelled from liquid dispenser 12. Similar to container member 18, expelling member 20 may also be made of any sturdy, lightweight, non-porous, non-corrosive material. Additionally, expelling member 20 may be made of the same material as container member 18. For expelling the liquid, expelling member 20 is illustrated as comprising spout portion 28 and pump portion 30.

Spout portion 28 preferably comprises any standard, currently-known spout, spigot, faucet, etc. for expelling the liquid from liquid dispenser 12. Moreover, spout portion 28 is preferably designed to accommodate the types of liquids, defined above, without much difficulty. That is, spout portion 28 should be readily adaptable for use with liquids possessing varying degrees of viscosity, from high viscosity fluids and powders, such as, for example, powdered or liquid soap, to low viscosity fluids, such as, for example, water. It is preferred that spout portion 28 be configured in any number of designs currently known in the art to dispense the liquid from liquid dispenser 12 in a substantially vertical and, more preferably, a substantially downward, direction.

Pump portion 30, whose interior mechanics are not shown in the Figures, provides a means by which the liquid contained within the containment cavity is transferred to spout portion 28 and eventual expulsion from liquid dispenser 12. Preferably, pump portion 30 may comprise any currently-known method of achieving the above-stated purpose, such as, for example, a vacuum-based pump and tube apparatus partially disposed within containment cavity and attached to spout portion 28.

To ensure the towels may be adequately dispensed, towel dispenser 14 is illustrated in the Figures as comprising core member 32, enclosing member 34, gripping member 36 and window member 38. Towel dispenser 14 is configured to receive a plurality of towels, as well as allow for the removal of the towels. The primary purpose of towel dispenser 14 is to protect the plurality of towels from the elements, such as, for example, rain and wind. Similar to the elements of liquid dispenser 12, the elements of towel dispenser 14, as described below, may also be made of any sturdy, lightweight, non-porous, non-corrosive material, such as, for example, a single piece of molded plastic.

Core member 32 possesses inner side 40 and outer side 42. Preferably, inner side 40 of core member 32 of towel dispenser 14 is sized such that it fits snugly around bottom portion 24 and middle portion 26 of container member 18 of liquid dispenser 12. That is, for example, if bottom portion 24 and middle portion 26 of container member 18 of liquid dispenser 12 is tubular in nature, as is illustrated in FIG. 1, and possessing an overall width, then inner side 40 of core member 32 of towel dispenser 14 possesses an inner width (the distance between one side of inner side 40 to another side) similar to, but slightly greater than, the overall width of bottom portion 24 and middle portion of container member 18. Similarly, if bottom portion 24 and middle portion 26 of container member 18 of liquid dispenser 12 is square or rectangular in nature, then inner side 40 of core member 32 of towel dispenser 14 would also be square or rectangular in nature, with an inner width slightly greater than the overall width of bottom portion 24 and middle portion 26 of container member 18.

Outer side 42 of core member 32 of towel dispenser 14 is preferably adapted to receive the plurality of towels, as disclosed above. It is contemplated that outer side 42 of core member 32 may be shaped such that the plurality of towels are disposed in a roll (which may be similar to paper towels currently for sale to the general public). Alternatively, outer side 42 of core member 32 can be configured and shaped such that the plurality of towels are disposed in a stack (i.e., similar to tissue boxes currently for sale to the general public).

As stated above, to ensure that towels are not exposed, enclosing member 34 preferably fits around core member 32, serving to protect the plurality of towels contained in core member 32 from the elements. Enclosing member 34, as illustrated in the Figures, nearly circumvents all of core member 32. However, enclosing member 34 is illustrated in FIG. 1 as containing first opening 44 and second opening 46. First opening 44 comprises a slit, or slotted shaped feature, that runs substantially through the vertical length of enclosing member 34. It is through first opening 44 that each of the plurality of towels is released from core member 32. Depending on the configuration of the plurality of towels in core member 32, first opening 44 may allow for one of the plurality of towels to be disposed partially in first opening 44 (similar to the manner in which tissue papers are disposed in a tissue paper box), thus allowing for a user to select one of the plurality of towels without having to reach inside enclosing member 34 to core member 32. Alternatively, first opening 44 may be designed to accommodate a user's hand inside enclosing member 34.

Gripping member 36, as illustrated, fits within second opening 46 of enclosing member 34. Gripping member 36 is preferably a contoured piece of material so as to allow a user to maintain, or steady, dispensing apparatus 10 while removing one of the plurality of towels.

For allowing a user to view the towels, window member 38, as illustrated, is disposed over enclosing member 34. This is particularly advantageous because in the preferred embodiment of the Present Invention, the towels may include advertisements or coupons to entice users into purchasing products or to present advertising to such users. More specifically, window member 38 is disposed over first opening 44 of enclosing member 34 and adjacent second opening 46 of enclosing member 34. Window member 38 is preferably made of a clear solid, so as to allow one to discern the availability of at least one of the plurality of towels present within core member 32. In addition to providing a "window" through which a user can determine if one of the plurality of towels is present within core member 32, window member 38 also provides protection, from wind and rain, to the plurality of towels disposed within core member 32.

Figure 4:
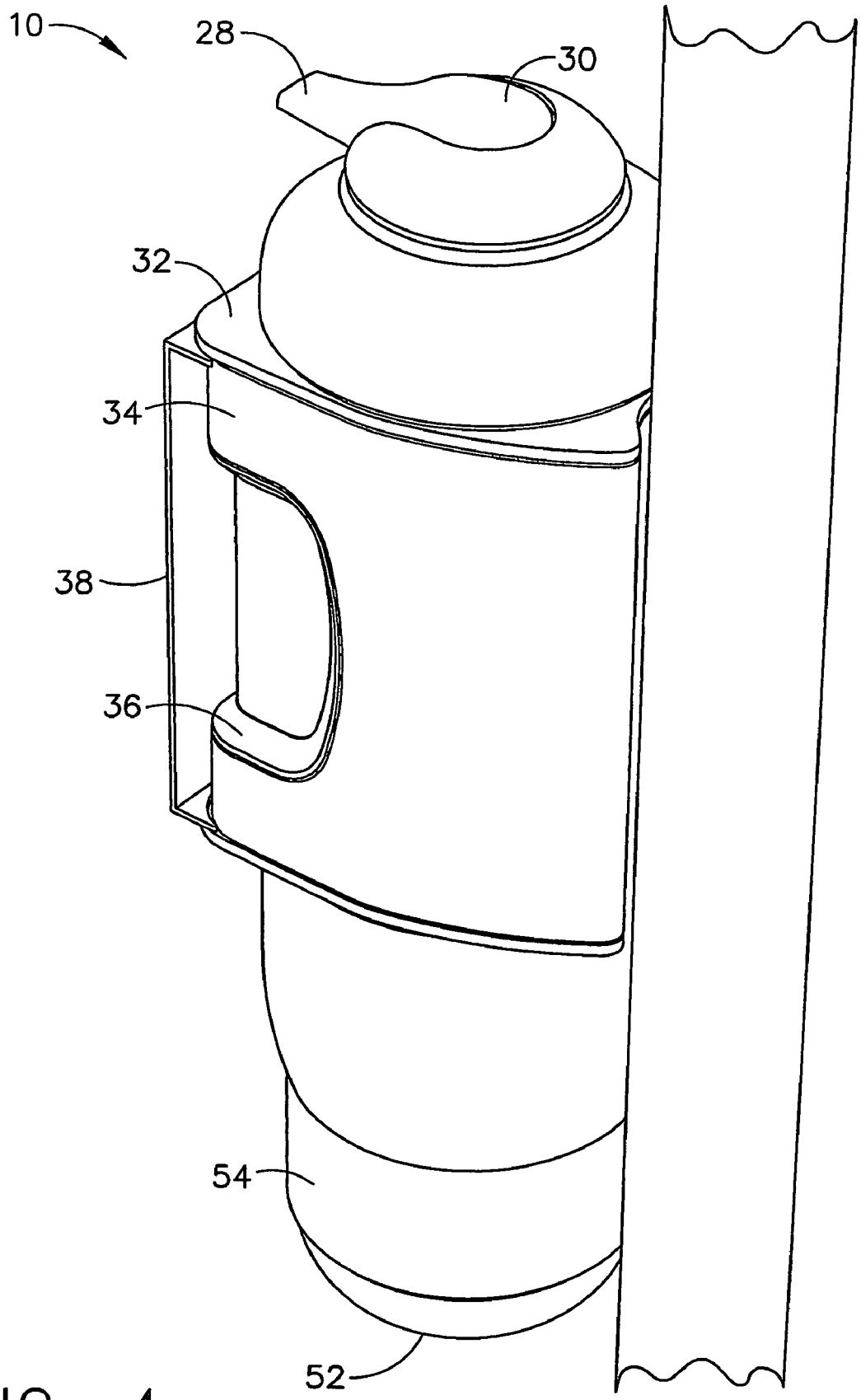
FIG. 4 illustrates a side view of the dispensing apparatus of FIG. 1 attached to a support member.

As illustrated by FIG. 4, core member 32 and enclosing member 34 may include a support member (not shown) for attaching the dispensing apparatus 10 to a stabilizing member such as a pole, as shown in FIG. 4. This will allow dispensing apparatus 10 to be attached to an object for ease of use. Additionally, it is contemplated that core member 32 and enclosing member 34 may be configured in a manner such that dispensing apparatus 10 may be attached to a wall, countertop, etc. and in a manner such that the dispensing apparatus 10 may be pivoted to more easily access the top portion 22 of the container member 18. It should also be understood that the support member, which may be of a well-known design, may also be attached to other portions of the dispensing apparatus 10.

Refuse collector 16 is disposed adjacent bottom portion 24 of liquid dispenser 12. Similar to the elements of liquid dispenser 12 and towel dispenser 14, the elements of refuse collector 16, as described below, may also be made of any sturdy, lightweight, non-porous, non-corrosive material, such as, for example, a single piece of molded plastic.

To facilitate the collection of refuse, refuse collector 16 comprises receptacle member 48 and door member 50. Receptacle member 48 possesses bottom portion 52 and substantially tubular portion 54. Bottom portion 52 and substantially tubular portion 54 collectively define refuse cavity 56. Acting as a refuse container for spent towels and other refuse, receptacle member 48 is preferably easily detachable from dispensing apparatus 10. Receptacle member 48 may also be configured such that a refuse bag (or similar item) can be placed inside receptacle member 48 within refuse cavity 56. Door member 50 is preferably disposed within a portion of the substantially tubular portion 54. Door member 50 allows a user to place refuse within refuse cavity 56.

While the Present Invention has been described in its currently preferred form, various modifications of these specific embodiments will be apparent to those in the art. For example, the size and/or dimensions of various parts of dispensing apparatus 10 may be altered without differentiating from the scope of the Present Invention. Additionally, individual parts of dispensing apparatus 10 may be rearranged without differentiating from the scope of the Present Invention. Thus, while specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A dispensing apparatus comprising:

a liquid-expelling apparatus, the liquid expelling apparatus comprising a container member and an expelling member;

the container member comprising a top portion, a bottom portion and a substantially tubular middle portion, the container member possessing a first width;

the top portion comprising an aperture, the top portion possessing a second width;

the bottom portion possessing a third width;

the substantially tubular middle portion possessing a fourth width;

the top portion, the bottom portion and the substantially tubular middle portion collectively defining a containment cavity in which a liquid may be deposited;

the expelling member being removably attached to the top portion of the container member, the expelling member being in communication with the liquid through the aperture;

the expelling member comprising a pump portion for urging the liquid from the containment cavity;

a spout portion, the spout portion being disposed such that the liquid is expelled from the containment cavity in substantially a downward direction;

a towel-enclosing apparatus, the towel-enclosing apparatus being disposed around the liquid-expelling apparatus, the towel-enclosing apparatus comprising a core member, an enclosing member, a gripping member and a window member;

the core member comprising an inner side and an outer side, the inner side of the core member having a second radius, the second radius being greater than the first radius such that the core member fits snugly around the container member, the outer side of the core member being adapted to receive a plurality of towels;

the enclosing member being disposed about a substantial portion of the core member and having a first opening defined therein and a second opening defined therein, the enclosing member protecting each of the plurality of towels and permitting the removal of one of the plurality of towels at a time;

the first opening of the enclosing member consisting primarily of a slotted shape substantially traversing the vertical length of the enclosing member;

the second opening of the enclosing member being disposed adjacent to the first opening of the enclosing member;

the gripping member being disposed within the second opening of the enclosing member;

the window member being disposes over the first opening of the enclosing member, a first side of the window member being removably attached to the enclosing member such that the window member is moveable from a first position to a second position to allow the release of one of the plurality of towels from the towel-enclosing apparatus;

a refuse-collecting apparatus, the refuse-collecting apparatus being disposed adjacent the bottom side of the liquid-expelling apparatus, the refuse-collecting apparatus comprising:

a receptacle member, the receptacle member having a bottom portion and a substantially tubular portion, the bottom portion and the substantially tubular portion collectively defining a refuse cavity; and a door member, the door member being disposed within a portion of the substantially tubular portion.

2. The dispensing apparatus of claim 1, wherein the towel dispenser provides towels that include coupons, which form part of the towel.

3. The dispensing apparatus of claim 2, wherein the core member is shaped to receive a plurality of towels disposed in a stack.

4. The dispensing apparatus of claim 1, wherein the towel dispenser includes a support member for attaching the dispensing apparatus to a stabilizing member.

5. The dispensing apparatus of claim 4, wherein the dispensing apparatus is pivotally connected to the stabilizing member by the support member.

6. The dispensing apparatus of claim 1, wherein the refuse container is removably attached to the bottom side of the liquid dispenser.

7. The dispensing apparatus of claim 1, wherein the core member is shaped to receive a plurality of towels disposed in a roll.

* * * * *